United States Patent [19]

Brown et al.

[11] Patent Number: 4,978,124

[45] Date of Patent: Dec. 18, 1990

[54] MARBLE SHOOTING TOY

[75] Inventors: Robert L. Brown, Lakeview; Robert D. Shilen, Tonawanda; Robert F. Rosnak, Depew, all of N.Y.

[73] Assignee: The Quaker Oats Company, Chicago, Ill.

[21] Appl. No.: 421,799

[22] Filed: Oct. 16, 1989

[51] Int. Cl.[5] ..... A63B 71/00

[52] U.S. Cl. ..... 273/129 S

[58] Field of Search ..... 273/129 R, 119 R, 119 A, 273/129 S; 124/7, 16, 20 A, 41 R, 45, 49

[56] References Cited

U.S. PATENT DOCUMENTS

| | | | |
|---|---|---|---|
| 1,336,556 | 4/1920 | Ebeling | 273/126 W |
| 3,048,915 | 7/1936 | Byers | 237/129 S |
| 3,224,776 | 12/1965 | Mehelich | 273/129 S |
| 3,656,753 | 4/1972 | Juneau | 273/129 S |
| 3,975,019 | 8/1976 | Barlow | 273/129 S |

*Primary Examiner*—Theatrice Brown

*Attorney, Agent, or Firm*—Cumpston & Shaw

[57] ABSTRACT

Apparatus for propelling an object along a surface only when the apparatus is positioned closely adjacent the surface and for inhibiting the object from being propelled when the apparatus is lifted from the surface, includes a magazine for holding a plurality of objects, means for releasing an object from the magazine into a launching position supported on the surface, and hammer means for propelling the object along the surface.

15 Claims, 2 Drawing Sheets

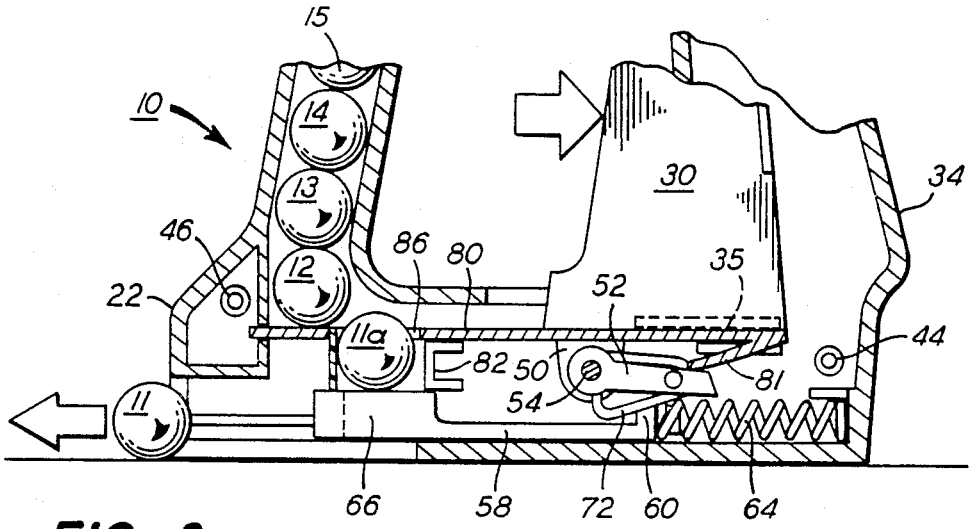
FIG. 3
FIG. 4
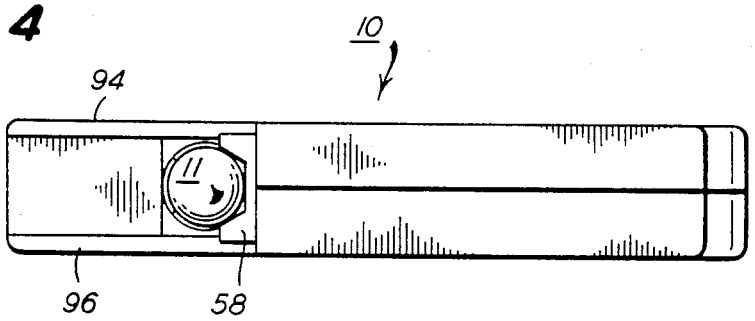
FIG. 5
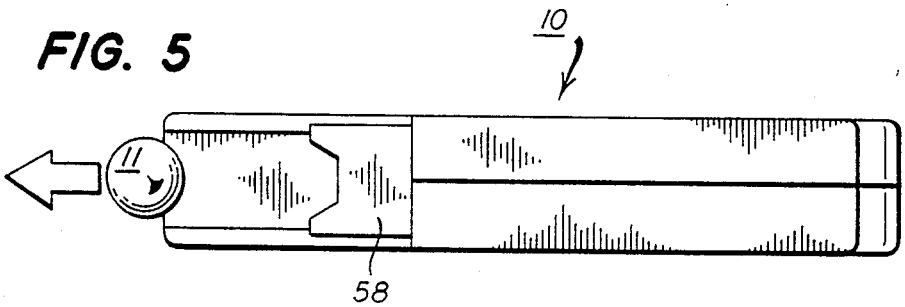

MARBLE SHOOTING TOY

This invention relates in general to marble games and more particularly to a marble shooter for propelling a marble along a surface when the shooter is positioned adjacent the surface.

Although marbles (which as used herein is intended to include ball bearings and similar objects in addition to conventional glass marbles) can and have for many years been propelled along surfaces by hand to play a wide variety of games, the technique of shooting a marble by hand can be difficult to master, and may be impossible for Young children to acquire. Accordingly, there is a need for easy to use apparatus that can be used to propel marbles along a surface, in order to allow the young and unskilled to play marble games.

In addition to providing the ease of operation and accuracy that are desirable in a marble shooter, a marble shooter must be designed with an appreciation for the possibility that children are disposed to use all sorts of objects as weapons. Marbles, if propelled at high speeds, can be dangerous, and it is advantageous that a marble shooter not be usable as a gun by those lacking the judgment necessary to refrain from attempting to do so.

Accordingly, it is an object of this invention to provide a marble shooter that is well suited for propelling a marble along a surface in playing a game, but which will not, without modification, function as a marble gun. Briefly stated, and in accordance with a presently preferred embodiment of this invention, apparatus for propelling an object along a surface only when the apparatus is positioned closely adjacent the surface and for inhibiting the object from being propelled when the apparatus is lifted from the surface, includes a magazine for holding a plurality of objects, means for releasing an object from the magazine into a launching position supported on the surface, and hammer means for propelling the object along the surface.

In accordance with another aspect of this invention, the apparatus includes a trigger, indexing means coupled to the trigger for supporting the objects in the magazine during firing and for positioning one object at a time in a firing position and another object in a ready to fire position upon each actuation of the trigger, and firing means coupling the hammer to the trigger for cocking and releasing the hammer for propelling an object from the firing position along the surface.

In accordance with still another aspect of this invention, the marble shooting apparatus includes resilient means coupled to the hammer for urging the hammer from a cocked position to a firing position, for propelling the object.

In accordance with a still further aspect of this invention, the hammer comprises an elongated slidably mounted member having a first end engaging the resilient means, and a second end engageable with the object.

In accordance with a still further aspect of this invention, the release means is coupled to the hammer means.

In accordance with yet a further aspect of this invention, the firing means includes means for moving the hammer to compress the resilient means, and then suddenly release the hammer.

While the novel aspects of the invention are set forth with particularity in the appended claims, the invention itself together with further objects and advantages thereof may be more fully appreciated by referring to the following detailed description of a presently preferred embodiment of the invention, taken in conjunction with the accompanying drawings in which:

FIG. 3 is a segmental side section of the marble shooter of this invention, showing a marble in the process of being propelled from the shooter;

FIG. 4 is a bottom plan view of the marble shooter of this invention as shown in FIG. 2; and FIG. 5 is a bottom plan view of the marble shooter of this invention as shown in FIG. 3.

Figure 1:
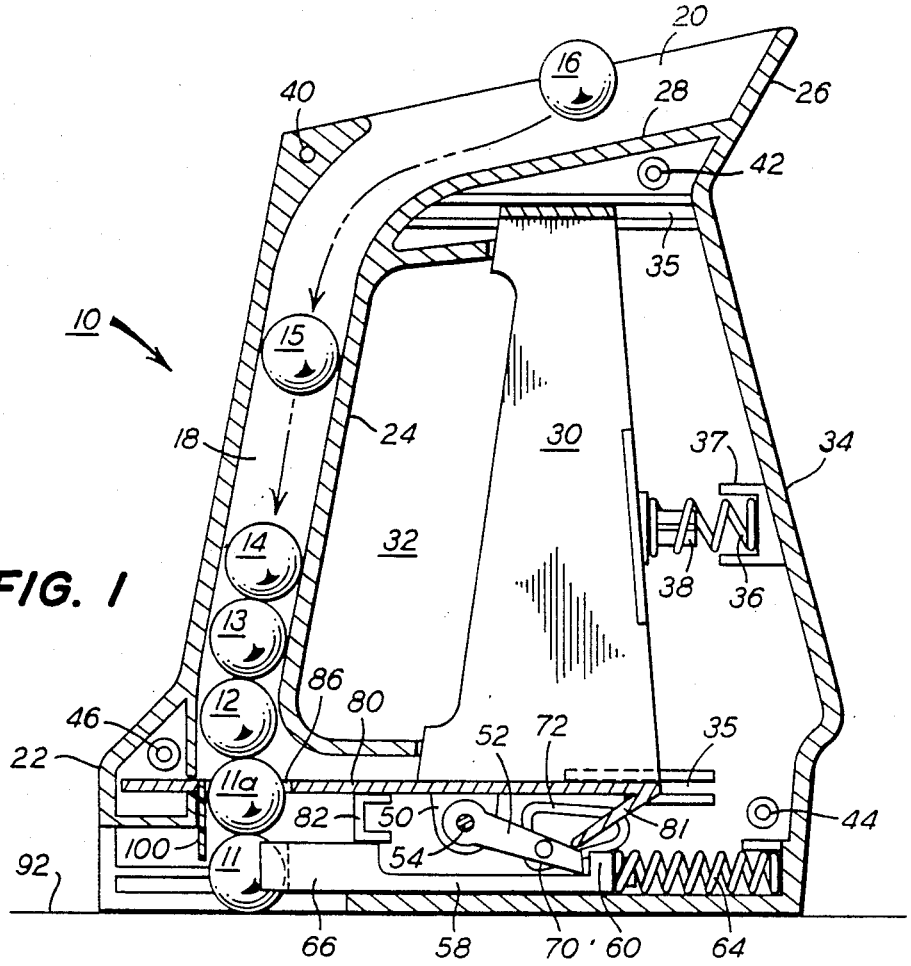
FIG. 1 is a side elevation, partly in section of a marble shooter in accordance with this invention, shown in a ready to fire position.

Referring now to FIG. 1, a marble shooter indicated generally at 10 is adapted to receive a plurality of round marbles or similar objects 11–16, within a generally vertically oriented tubular magazine 18, into which the marbles may be loaded through a hopper 20. Preferably, marble shooter 10 is formed from easy to manufacture plastic parts, which are preferably molded to reduce the cost thereof. Marble shooter 10 includes a housing 22 having a first generally cylindrical walls 24 forming magazine 18 for receiving the marbles. An upwardly facing, open, U-shaped wall 26 forms hopper 20, having a downwardly sloping bottom wall 28 for feeding marbles into the magazine.

A trigger 30 is slidably mounted in the shooter housing, and is especially well adapted to be gripped with one hand by placing the fingers through an opening 32 and squeezing the trigger 30 with respect to rear wall 34 of the housing. Preferably, the upper and lower surfaces of the trigger are guided in slots 35 formed in the housing. A resilient member, such as a coil spring 36, having one end attached to a mounting post 38 on the trigger, and the other end retained in a mounting cup 37 attached to rear wall 34 biases trigger 30 to its ready position as shown in FIG. 1. Preferably, the shooter is formed from two substantially mirror image housing members are held together with suitable fasteners such as screws, rivets or the like, passing through openings 40, 42, 44, and 46.

Trigger 30 includes a downwardly extending boss 50, having an outwardly extending post 54, on which a firing arm 52 is pivotally mounted. Firing arm 52 is adapted to engage a hammer 58 at an upstanding stop 60 on one end thereof. Hammer 58 is slidably mounted in housing 22, and is resiliently urged by compression spring 64 to a ready to fire position as shown in FIG. 1. Preferably, a firing end 66 of hammer 58 is generally concave, or notched, for matingly engaging and centering a marble in the ready to fire position. A flexible tang 100 holds marble 11 in a ready to fire position as long as the shooter is held in position closely adjacent surface 92. However, if shooter 10 is raised from the surface, all of the marbles run out.

Figure 2:
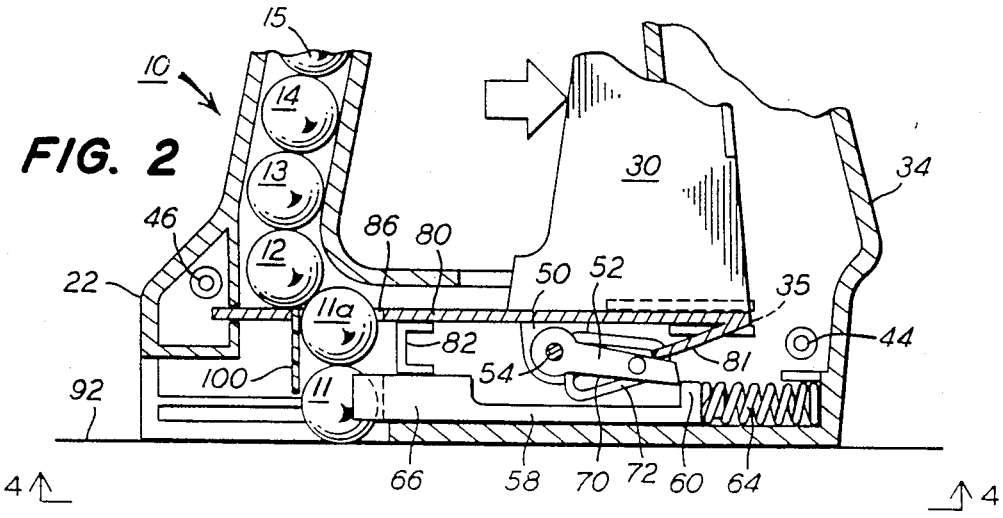
FIG. 2 is a segmental side elevation, partly in section of the marble shooter of FIG. 1, showing the marble shooter in a cocked position near the end of a trigger squeeze with a marble about to be propelled from the "shooter"

Firing arm 52 has a cam follower pin 70 projecting laterally from the arm 52 at a point intermediate the pivot point and the end of the firing arm, into engagement with a lower portion of a triangular cam 72, formed in a side wall of the shooter housing having a surface sloping upwardly to the rear. Cam follower 70 pivots firing arm 52 upwardly from a position engaging end portion 60 through an intermediate position as shown in FIG. 2, to a release position as shown in FIG. 3, as trigger 30 is squeezed, and the firing arm is moved rearwardly and upwardly by the cam follower. Spring 81 maintains cooperative engagement between the cam and cam follower. The end of firing arm 52 urges stop 60 of hammer 58 into compressing engagement with spring 64, as the trigger is squeezed (see FIG. 2).

One marble at a time is moved from magazine 18 to a next to fire position by reciprocating trigger indexing bar 80, which is slidably supported by a bracket 82 of the housing. Indexing bar 80 includes an opening 86 therethrough having an inside diameter at least slightly greater than the outside diameter of the marbles 11–16. After initially loading the magazine, when the indexing bar 80 is moved to its most forward position, as shown in FIG. 1, two marbles 11 and 11*a* drop through opening 86. One marble 11*a* drops to a next ready to fire position disposed within opening 86 and supported on the other marble 11, which drops to a firing position supported on surface 92. Marble 11 is held in firing position against hammer 58 by the flexible tang 100. Spring 64 is uncompressed at this point and trigger 30 is urged to its ready position by spring 36. As trigger 30 is squeezed as shown in FIG. 2, spring 36 is compressed. Indexing bar 80 hammer 58 and tang 100 slide rearwardly, and opening 86 and tang 100 move marbles 11 and 11*a* to a ready position rearwardly of the marbles 12–16 stacked in the magazine. The weight of the marbles in the magazine is supported by the forward end of indexing bar 80 during firing. Marble 11 is in a firing position supported on surface 92, and marble 11*a* is in a staged position. The firing position is illustrated in FIGS. 2 and 4, and the notched end of hammer 58 engages the marble 11 as may be most readily seen in FIG. 4. Marble 11 is guided between side walls 94 and 96, so as to travel in a relatively straight line when fired. If shooter 10 is raised from the surface 92 before the time trigger 30 is squeezed, all of the marbles 11–16 drop from the shooter. If the shooter is raised from the surface during firing, marbles 11 and 11*a* drop without being fired.

Referring again to FIG. 2, as cam follower 70 moves firing arm 52 incrementally upward beyond the position shown in FIG. 2, the hammer 58 is released and moves suddenly forward through the position shown in FIG. 3 by spring 64 to propel marble 11 outwardly from the shooter. This is also shown in FIG. 5. After launching a marble, handle 30 is released and returns to its ready position as shown in FIG. 1. Indexing bar 80 moves to the forward position shown in FIG. 1, dropping a marble 11*a* into the firing position and allowing the next marble 12 to drop into the staging position, and the shooter is again ready for firing. Resilient member 81 attached to an end of indexing member 80 bears against firing arm 52 to maintain the cam follower in contact with cam 72 during firing.

While the invention has been shown and described in connection with a presently preferred embodiment thereof, those skilled in the art will recognize that many modifications and changes may be made therein without departing from the true spirit and scope of the invention, which accordingly is intended to be defined solely by the appended claims.

What is claimed is:

1. An apparatus for propelling objects over a playing surface comprising:

an upstanding housing, said housing having a lower wall, an opening extending through said lower wall, said opening being of a size to allow said objects to pass through said housing and onto a playing surface, indexing means attached to said housing an spaced from said lower wall for controlling gravitational movement of a said object through said housing and opening said housing having a magazine for holding a plurality of said objects, means for moving said indexing means to thereby release a said object to place said object in firing position on said playing surface when said lower wall is placed such that a said ball is in contact with said playing surface and in firing position on said playing surface, and hammer means intermediate said indexing means and said lower wall for propelling a said object from said firing position and thus along the playing surface.

2. The apparatus of claim 1 further comprising trigger means said indexing means being coupled to said trigger means for positioning one object at a time into said firing position upon actuation of said trigger means, and means coupling the hammer means to the trigger means for moving said hammer means from said firing position to a cocked position.

3. The apparatus of claim 2 further comprising resilient means coupled to the hammer means for urging said hammer means from said cocked position to said firing position for propelling a said object.

4. The apparatus of claim 3 wherein said hammer means comprises an elongated slidably mounted member having a first end engaging said resilient means and a second end engageable with a said object.

5. The apparatus of claim 4 wherein said indexing is coupled to said trigger means for releasing a said object form a staging position to a firing position and moving said object from said magazine to a staging position when said trigger means is released.

6. The apparatus of claim 3 wherein said means coupling said hammer means to said trigger means is functional compress said resilient means and then suddenly release said hammer means.

7. The apparatus of claim 6 wherein said trigger means comprises a gripable handle, movable by squeezing said handle relative to said housing relative to said housing said apparatus.

8. The apparatus of claim 6 comprising second resilient means engaging said trigger means for biasing said trigger means to a ready position.

9. The apparatus of claim 3 wherein said means coupling said hammer means to said trigger means comprises and arm pivotally mounted to said trigger means and engaging said hammer means to compress said resilient means and releasable from said hammer member to allow the hammer member to propel the object.

10. The apparatus of claim 9 further comprising cam means and cam follower means engaging said arm for releasing said arm from said hammer means after said resilient means are compressed.

11. The apparatus of claim 2 wherein said indexing means comprises a member slidably mounted with respect to said magazine and including an opening for receiving a single said object and moving said object from said magazine to a staging position.

12. The apparatus of claim 11 in which said firing position is offset from said magazine.

13. The apparatus of claim 12 in which said hammer means comprises a notch and further comprising a first side wall and a second side wall, said first and second side walls guiding a said object as it is being propelled by said hammer means.

14. The apparatus of claim 2 comprising flexible means for positioning a said object in firing position relative to said hammer.

15. The apparatus of claim 14 in which said flexible means comprises a flexible tang disposed in the firing path of a said object.

* * * * *